US007445205B2

(12) United States Patent
Soures et al.

(10) Patent No.: US 7,445,205 B2
(45) Date of Patent: Nov. 4, 2008

(54) AUTOMATICALLY VARIABLY HEATED AIRFLOW FOR SEPARATION OF HUMID COATED PAPER PRINT MEDIA

(75) Inventors: Michael N. Soures, Webster, NY (US); Robert A. Gross, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 340 days.

(21) Appl. No.: 11/327,633

(22) Filed: Jan. 6, 2006

(65) Prior Publication Data

US 2007/0158897 A1 Jul. 12, 2007

(51) Int. Cl.
*B65H 3/14* (2006.01)

(52) U.S. Cl. ..... 271/97; 271/98

(58) Field of Classification Search ..... 271/97
See application file for complete search history.

(56) References Cited

U.S. PATENT DOCUMENTS 3,603,680 A 9/1971 Barton
3,627,311 A 12/1971 Spinelli
5,138,178 A 8/1992 Wong et al.
5,356,127 A * 10/1994 Moore et al. ..... 271/11
5,847,405 A 12/1998 Acquaviva et al.
5,859,440 A 1/1999 Acquaviva
6,338,480 B1 * 1/2002 Endo ..... 271/104
6,349,930 B1 * 2/2002 Kruger et al. ..... 271/104
6,389,241 B1 * 5/2002 Cernusak et al. ..... 399/44
6,450,493 B1 * 9/2002 Milillo et al. ..... 271/11
6,543,761 B2 * 4/2003 Endo ..... 271/110
6,581,456 B1 * 6/2003 Clark ..... 73/159
6,668,155 B1 12/2003 Hubble, III et al.
6,726,200 B2 * 4/2004 Gohl et al. ..... 271/97
6,746,011 B2 6/2004 Miller et al.
6,748,801 B2 * 6/2004 Clark ..... 73/159
6,768,884 B1 * 7/2004 Buchheit ..... 399/88
6,945,525 B2 9/2005 Mathewson
6,955,348 B2 * 10/2005 Koga ..... 271/97
7,140,606 B2 * 11/2006 Suga et al. ..... 271/97
7,237,771 B2 * 7/2007 Lang et al. ..... 271/9.01
7,249,759 B2 * 7/2007 Komatsu et al. ..... 271/97
7,364,150 B2 * 4/2008 Nakane ..... 271/97
2002/0060397 A1 * 5/2002 Endo ..... 271/121
2002/0070494 A1 * 6/2002 Milillo et al. ..... 271/98
2004/0089994 A1 * 5/2004 Koga et al. ..... 271/98
2004/0100013 A1 * 5/2004 Mathewson ..... 271/98
2005/0040584 A1 * 2/2005 Isemura ..... 271/97

(Continued)

FOREIGN PATENT DOCUMENTS

JP 62249835 A * 10/1987

(Continued)

*Primary Examiner*—Patrick H Mackey
*Assistant Examiner*—Howard Sanders
(74) *Attorney, Agent, or Firm*—Fay Sharpe, LLP

(57) ABSTRACT

Sheet separation, feeding and printing with reduced image deletions of various types of print media sheets from a stack thereof, especially coated print media sheets with high humidity adhesion difficulties, is assisted by a sheet air puffer for a sheet separator/feeder having an automatically variably heated air supply. This may be accomplished by electronically obtaining information on the selected type of print media sheets to be fed from the sheet separator/feeder, and the ambient conditions, including at least the humidity, and by combining that information in an electronic look-up table additionally provided with set points to produce a control signal for variable air puffer temperature and strength.

6 Claims, 1 Drawing Sheet

U.S. PATENT DOCUMENTS

2005/0053401 A1* 3/2005 Matsumoto et al. ..... 399/390
2005/0063023 A1* 3/2005 Komatsu et al. ..... 358/488
2005/0067757 A1* 3/2005 Suga et al. ..... 271/98
2005/0133980 A1* 6/2005 Koga ..... 271/97
2006/0170145 A1* 8/2006 Nakane ..... 271/97
2006/0175746 A1* 8/2006 Adachi ..... 271/97

FOREIGN PATENT DOCUMENTS

JP 2001088964 A * 4/2001
JP 2004131291 A * 4/2004

* cited by examiner

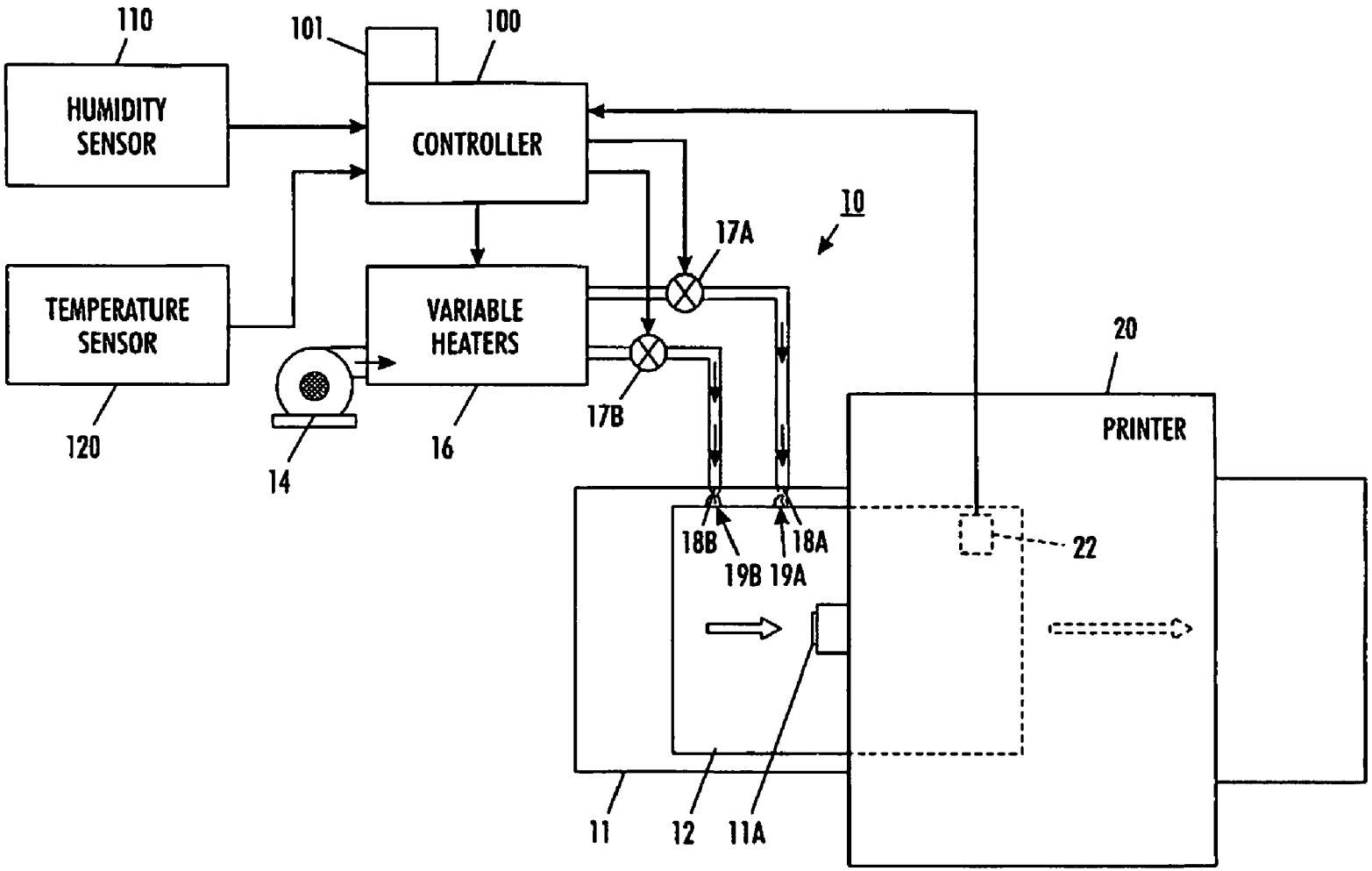
FIGURE

AUTOMATICALLY VARIABLY HEATED AIRFLOW FOR SEPARATION OF HUMID COATED PAPER PRINT MEDIA

Disclosed in the embodiments herein is an improvement in sheet separation, feeding and printing with reduced image deletions of various types of print media sheets from a stack thereof, especially coated print media sheets with potential high humidity adhesion difficulties and potential imaging difficulties with uneven humidity. A sheet air puffer system for a sheet separator/feeder having an automatically variably heated air supply is disclosed. This may be accomplished by electronically obtaining information on the selected type of print media sheets to be fed from the sheet separator/feeder, and the printer ambient conditions, including at least the humidity, and by combining that and other information to produce a control signal for the variable air puffer temperature, and optionally additionally the air puffer strength.

Of particular background art interest, and incorporated by reference herein, is Xerox Corp. U.S. Pat. No. 6,945,525, entitled "Sheet Feeding Apparatus Having an Adaptive Air Fluffer" by Mark D. Mathewson, issued Sep. 20, 2005. It's Abstract reads: "A sheet feeding apparatus for feeding a stack of sheets in a direction of movement to a process station, including: a sheet from the stack of sheets when a vacuum force in the air plenum; a paper fluffer for blowing air between individual sheets in the stack, the paper fluffer having means for adjusting air flow between individual sheets." Col. 1, line 51, of this same patent also incidentally mentions that "even with heat" higher fluffer "air pressure is needed to break up the sheet pairs inherent in coated stocks." Likewise, Col. 6, lines 27-31. Various other examples of patents with sheet separator/feeders with (unheated) air sheet fluffers are cited in this patent, and also in Xerox Corp. U.S. Pat. No. 6,746,011 issued Jun. 8, 2004, because the disclosed embodiment is not limited to a specific type or location of fluffer or sheet feeder.

Further by way of background, it is believed that there is at least one Xerox Corporation printer product, the "Nuvera® 110" printer, which has been on sale for approximately five years, has had an air heating system (somewhat like a hair dryer) with just an on or off control (not with any temperature control) that is turned on by the combination of two electrical signals, respectively, a signal from a humidity sensor in the printer and an operator's manual selection of a "coated paper" input on the printer's graphic user interface (GUI) touch screen. When thus activated, the air heater heats the air supplied to the air puffer of the sheet separator/feeder system for that printer.

The difficulties and importance of paper sheet feeding and paper path control and print quality in printers is well known to those skilled in the art. For example, the avoidance of double sheet feeding or image deletions on stressed substrates such as coated papers, which tend to stick together at higher humidity levels. It has been found that attempted solutions with higher paper fluffer temperatures and paper fluffer air velocities in the sheet separator/feeder can cause localized dryness of the areas of the sheet engaged by that heated air flow compared to other areas of the sheet. This can undesirably unevenly change the resistivity and/or deformation of the sheet. If that cannot otherwise be compensated for adequately in the image transfer station of the printer, etc., it can even result in localized image deletions in the body of the image print on that sheet.

By way of further background incorporation by reference as to print media sheet property sensing, sheet feeders and associated printers, various types of on line or other print media sheet properties sensing or sheet properties input systems such as for sheet thickness, beam strength, basis weight, etc. have been proposed for printers using various technologies: pressure sensitive, acoustic, infra-red, pneumatic, piezoelectric, and sheet electrical conductivity such as measured between a nip of sheet path conductive rollers, etc. Coated paper can, for example, be detected in the same general manner as plastic transparency print media is detected, by known optical angular reflective sensing in which the smoother surface of the coated papers have a higher Brag angle specular reflectance than their off-angle diffuse reflectance as compared to normal print media paper. Examples of angled optical sheet detectors include Xerox Corp. Pat. Nos. 6,668,155 B1 issued Dec. 12, 2003, U.S. Pat. Nos. 5,847,405 and 5,859,440, cited therein. The following patent disclosures are noted merely by way of some examples of sheet thickness sensors (detectors): Xerox Corp. U.S. Pat. Nos. 5,138,178, 3,603,680 and 3,627,311. Some printer products have installed automatic print media thickness sensing systems for improved user convenience and printing quality. One that is known is the Omron™ Z4D-A01 reflective displacement sensor. As understood, it uses optical triangulation to measure distance. Distance is measured to a roller or backing surface, then the distance is measured again to the print media as it passes over the roller or backing surface. The difference between these two measured distances is the indicated print media thickness.

A specific feature of the specific embodiment disclosed herein is to provide a printer in which various types of print media sheets are separated from a stack thereof in a sheet separator/feeder and fed individually for imaging, wherein some of said print media sheets include coated paper print media sheets with high humidity adhesion separation difficulties and uniform imaging difficulties caused by excessively non-uniform humidity areas, the improvement comprising a variable temperature air puffer for pneumatically engaging sheets stacked in said sheet separator/feeder for sheet separation assistance; said variable temperature air puffer having a variable temperature heated air supply and an automatic control system for said variable temperature heated air supply; said automatic control system for said variable temperature heated air supply including electronic signal information on the type of print media sheets in said sheet separator/feeder; said automatic control system further including electronic signal information on ambient conditions including at least ambient humidity information; said automatic control system further including set points information for said electronic signal information on the type of print media sheets and said electronic signal information on ambient conditions, for automatically providing in response thereto control signals for said variable temperature heated air supply for said variable temperature air puffer for said coated paper print media sheets, to provide said variable temperature air puffer with an air temperature appropriate for separation of coated paper print media sheets but without causing excessively non-uniform humidity areas of said coated paper print media sheets.

Further specific features disclosed in the embodiment herein, individually or in combination, include those wherein said variable temperature air puffer has a variable air flow, and said automatic control system also automatically varies said variable air flow; and/or an improved method of sheet separation and feeding of various types of print media sheets individually from a stack thereof in a sheet separator/feeder having a sheet air puffer with a heated air supply, said various types of print media sheets including coated print media sheets with high humidity adhesion difficulties in separating said individual coated paper print media sheets from said stack thereof, comprising electronically obtaining and storing information on the selected type of print media sheets to be fed from said sheet separator/feeder; electronically obtaining and storing ambient conditions information including at least ambient humidity information; combining said electronic information on the selected type of print media sheets to be fed from said sheet separator/feeder with said electronic information on the ambient humidity information in an electronic look-up table additionally provided with set points to produce a control signal for said sheet air puffer with a heated air supply; and automatically varying the temperature of said heated air supply for said sheet air puffer of said sheet separator/feeder in accordance with said control signal; and/or wherein electronic information on the selected type of print media sheets to be fed from said sheet separator/feeder with said electronic information on the ambient humidity information in an electronic look-up table additionally provided with set points additionally produces a control signal automatically controlling the air flow from said sheet air puffer; and/or a printing method in which various types of print media sheets are separated from a stack thereof in a sheet separator/feeder and fed individually for imaging, wherein some of said print media sheets include coated paper print media sheets with high humidity adhesion separation difficulties and uniform imaging difficulties caused by excessively non-uniform humidity areas, comprising engaging sheets stacked in said sheet separator/feeder with a variable temperature air stream for sheet separation assistance; said variable temperature air stream being heated by a variable temperature air heater controlled by an automatic control system; providing said automatic control with electronic signal information on the type of print media sheets in said sheet separator/feeder; providing said automatic control system with electronic signal information on ambient printing conditions including at least ambient humidity information; said automatic control system further including set points information for the type of print media sheets and the ambient conditions; said automatic control system automatically providing in response to said electronic signal information and said set points information a control signal for said variable temperature air heater for said variable temperature air stream for said coated paper print media sheets to provide an air stream temperature appropriate for separation of coated paper print media sheets without causing excessively non-uniform humidity areas of said coated paper print media sheets; and/or wherein said variable temperature air stream has a variable air flow rate which is additionally controlled by said automatic control system.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The terms "sheet" or "print media" refers to a usually flimsy physical sheet of paper, plastic, or other suitable physical substrate for images, whether precut or web fed. The term "fluffer" may be considered interchangeable or coextensive with "puffer" or "air knife" herein, as they are similar terms of art in sheet separator/feeders for printers.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, they will be better understood from this description of one specific embodiment, including the drawing figures (which are approximately to scale) wherein:

FIG. 1 (the FIGURE) is a schematic top view of one example of the subject variably automatically controlled sheet puffer system in an otherwise conventional sheet feeder/separator for an otherwise conventional printer.

Describing now in further detail the exemplary embodiment with reference to the FIGURE, there is shown one example 10 of an automatic system and method of variably controlling the air temperature and air flow of sheet fluffers 18A, and 18B for a sheet separator/feeder 11 with a sheet feed head 11A for improved separating and feeding of individual sheets 12, especially coated or other difficult print media sheets, from a stack thereof for printing in a printer 20 with reduced print image defect problems from fluffing such sheets with heated air, such as discussed above. The numbers, positions and types of fluffers illustrated here are merely exemplary and not limiting. The above cited and incorporated patents provide details of, and alternatives for, of all of these components, which need not be re-described herein for those skilled in the art.

As additionally shown in this example system 10, the fluffers 18A and 18B are provided with their sheet stack side or edge airflow for sheets 12 separating assistance by a conventional blower 14. However, here the output of the blower 14 passes though a variable heater 16, the otherwise conventional electrical heating elements of which may have a variable amount of current applied thereto controlled by the controller 100 software. The variably controlled temperature airflow out of the variable heater 16 may then pass though conventional or other fluffer airflow control values such as 17A and 17B, which here may also be controlled by the controller 100 software. This controls the airflow level or amount from the output nozzles of the fluffers 18A and 18B blowing against the sheets 12. The heated air directed by the fluffers against the fed sheet 12 will cause adjacent areas 19A and 19B of that sheet 12 to be heated, changing its relative humidity and conductivity, and possibly a slight buckle or other deformation, in those areas 19A and 19B.

The input controls for the controller 100 for its above function may be fully automated as follows, but not limited thereto. As shown in this example 10, an ambient humidity sensor 110, a temperature sensor 120, and paper type and/or paper condition sensors 22, which may be in the paper path within the printer 20, provide input signals to controller 100. They may be processed as described below or otherwise to provide the above output signals. Examples in more detail of various print media type and condition sensors have been previously noted above.

In the disclosed embodiment, various of the above-noted and other problems are addressed. In this example, there is provided a control of the sheet separator/feeder module 11 fluffers 18*a* and 18B air temperature and air velocity based on ambient conditions such as humidity and temperature, and paper conditions, such as paper coating, paper thickness, and/or paper resistivity, (which can vary with moisture content on a sheet by sheet basis). This information may be used with electronic look-up tables 101 in the controller 100 or elsewhere that can cross-reference desired set points or ranges with, for example, typical wrapped or conditioned moisture properties of various print media substrates being fed from the sheet separator/feeder module 11.

This embodiment 10 thus provides control logic for sheet separator/feeder fluffer set points to accommodate the potential moisture content of the print media paper 12, and/or paper 12 properties such as gsm weight, the substrate and coating type and/or look-up tables estimating the percentage of sheet resistivity change possible through heated puffer air action on the sheet 12 prior to image transfer in the printer 20. This may even be accomplished on an individual sheet-by-sheet basis if desired.

That is by allowing machine control software to monitor the gsm and other substrate properties, plus machine ambient conditions (percent relative humidity and temperature), lookup tables therefore can be created which cross-reference the potential wrapped and conditioned moisture properties of various typically utilized print media. This knowledge can be leveraged against the printer 20 components latitude necessary to reliably feed and fully image that print media type. From that stored information an appropriate sufficient air temperature and air velocity can be delivered to the fluffers that will separate the sheets yet not cause printing image quality defects.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. In a printer in which various types of print media sheets are separated from a stack thereof in a sheet separator/feeder and fed individually for imaging, wherein some of said print media sheets include coated paper print media sheets with high humidity adhesion separation difficulties and uniform imaging difficulties caused by excessively non-uniform humidity areas, the improvement comprising:

a variable temperature air puffer for pneumatically engaging sheets stacked in said sheet separator/feeder for sheet separation assistance;

said variable temperature air puffer having a variable temperature heated air supply and an automatic control system for said variable temperature heated air supply;

said automatic control system for said variable temperature heated air supply including electronic signal information on the type of print media sheets in said sheet separator/feeder;

said automatic control system further including electronic signal information on ambient conditions including at least ambient humidity information;

said automatic control system further including set points information for said electronic signal information on the type of print media sheets and said electronic signal information on ambient conditions, for automatically providing in response thereto control signals for said variable temperature heated air supply for said variable temperature air puffer for said coated paper print media sheets, to provide said variable temperature air puffer with an air temperature appropriate for separation of coated paper print media sheets but without causing excessively non-uniform humidity areas of said coated paper print media sheets.

2. The printer of claim 1, wherein said variable temperature air puffer has a variable air flow, and said automatic control system also automatically varies said variable air flow.

3. An improved method of sheet separation and feeding of various types of print media sheets individually from a stack thereof in a sheet separator/feeder having a sheet air puffer with a heated air supply, said various types of print media sheets including coated print media sheets with high humidity adhesion difficulties inseparating said individual coated paper print media sheets from said stack thereof,comprising:

electronically obtaining and storing information on the selected type of print media sheets to be fed from said sheet separator/feeder;

electronically obtaining and storing ambient conditions information including at least ambient humidity information;

combining said electronic information on the selected type of print media sheets to be fed from said sheet separator/feeder with said electronic information on the ambient humidity information in an electronic look-up table additionally provided with set points to produce a control signal for said sheet air puffer with a heated air supply; and automatically varying the temperature of said heated air supply for said sheet air puffer of said sheet separator/feeder in accordance with said control signal.

4. The improved method of sheet separation and feeding of various typesof print media sheets of claim 3, wherein electronic information on the selected typeof print media sheets to be fed from said sheet separator/feeder with said electronic information on the ambient humidity information in an electronic look-up table additionally provided with set points additionally produces a control signal automatically controlling the air flow from said sheet air puffer.

5. A printing method in which various types of print media sheets are separated from a stack thereof in a sheet separator/feeder and fed individually for imaging, wherein some of said print media sheets include coated paper print media sheets with high humidity adhesion separation difficulties and uniform imaging difficulties caused by excessively non-uniform humidity areas, comprising:

engaging sheets stacked in said sheet separator/feeder with a variable temperature air stream for sheet separation assistance;

said variable temperature air stream being heated by a variable temperature air heater controlled by an automatic control system;

providing said automatic control with electronic signal information on the type of print media sheets in said sheet separator/feeder;

providing said automatic control system with electronic signal information on ambient printing conditions including at least ambient humidity information;

said automatic control system further including set points information for the type of print media sheets and the ambient conditions;

said automatic control system automatically providing in response to said electronic signal information and said set points information a control signal for said variable temperature air heater for said variable temperature air stream for said coated paper print media sheets to provide an air stream temperature appropriate for separation of coated paper print media sheets without causing excessively non-uniform humidity areas of said coated paper print media sheets.

6. The printing method of claim 5, wherein said variable temperature air stream has a variable air flow rate which is additionally controlled by said automatic control system.

* * * * *